US005499007A

United States Patent [19]

Flohr

[11] Patent Number: 5,499,007

[45] Date of Patent: Mar. 12, 1996

[54] CIRCUIT BREAKER

[75] Inventor: Peter Flohr, Kahl/Main, Germany

[73] Assignee: Heinrich Kopp AG, Kahl/Main, Germany

[21] Appl. No.: 228,627

[22] Filed: Apr. 18, 1994

[30] Foreign Application Priority Data

Apr. 22, 1993 [DE] Germany ..... 43 13 207.3

[51] Int. Cl.[6] ..... H01H 9/30

[52] U.S. Cl. ..... 335/201; 335/35; 335/167; 335/172

[58] Field of Search ..... 335/201, 167–176, 335/23–25, 16, 147, 195; 200/147 R, 144 R

[56] References Cited

U.S. PATENT DOCUMENTS

| | | | |
|---|---|---|---|
| 537,130 | 4/1895 | Sperry | 335/201 |
| 3,978,300 | 8/1976 | Slade | 200/147 R |
| 4,001,743 | 1/1977 | Arnold | 335/201 |

FOREIGN PATENT DOCUMENTS

| | | |
|---|---|---|
| 144799B1 | 6/1985 | European Pat. Off. . |
| 506503A1 | 9/1992 | France . |
| 3031549A1 | 4/1982 | Germany . |
| 3347097A1 | 7/1985 | Germany . |
| 3637275C1 | 5/1988 | Germany . |
| 3915127C1 | 9/1990 | Germany . |
| 3917326A1 | 11/1990 | Germany . |

*Primary Examiner*—Lincoln Donovan
*Attorney, Agent, or Firm*—Lowe, Price, LeBlanc & Becker

[57] ABSTRACT

A circuit breaker comprises high-duty arc-quenching means 23 and a latching mechanism 19, which is adapted to be electromagnetically and thermoelectrically unlatched by means of a snap-action bimetal disk 52 to open contacting means 21 in response to an overload. The snap-action bimetal disk 52 is held in a carrying body 32, which has a high thermal conductivity and which carries an electromagnetic exciter coil 33 and contains an associated plunger 42. For tripping in response to an overload, the plunger 42 is adapted to be actuated either electromagnetically and/or by the snap-action bimetal disk 52. The movable contact 21 will remain open when the latching mechanism 19 has been unlatched. In response to a movement of the plunger 42 out of its make position, the latching mechanism 19 is unlatched by a first arm of a two-armed lever 37, which is made of lucite and is pivoted to the carrying body 42. The contacting means 21 are adapted to be struck open by the second arm 41 of the lever 37. The second arm is integrally formed with a baffle wall 43, by which a plasma or electric arc column that is generated as the contacting means 21 are struck open is urged toward the arc-quenching means 23.

13 Claims, 2 Drawing Sheets

CIRCUIT BREAKER

BACKGROUND OF THE INVENTION

1. Field of the Invention

This invention relates to a circuit breaker for the protection of lines against thermal overload and short circuits.

2. Description of the Prior Art

Such circuit breakers usually comprise terminals, contacting and quenching means, and a latching mechanism, which is adapted to be electromagnetically and thermoelectrically unlatched to open movable contacts in response to an overload. As has been mentioned, e.g., in EP 0 144 799, it is essential to provide a high switching capacity within a small overall size. A high switching capacity requires that the arc-quenching means are as large as possible.

Whereas EP 0 144 799 provides for that purpose a compact latching mechanism, it provides for the thermal and magnetic release a system which requires improvement as regards the simplification of its functional concept and a highly mechanized manufacture. This is particularly applicable to the number of parts and the number of welded joints required along the line.

Besides, circuit breakers are required to have a high short circuit breaking capacity and experience has shown that this imposes a high stress on conventional bimetal trips and shortens the useful life. In addition, such circuit breakers are manufactured in large numbers as they are required on any small distribution board and are permitted to have only a small power consumption themselves.

There is also a desire for a further decrease of the structural expenditure and for a further kinematic simplification, particularly as regards the spatial separation of important functional groups, on the one hand, and the possibility to provide a circuit breaker having a higher switching power within the conventional overall size.

DE 36 37 275 discloses for electric protective switching devices an overcurrent trip, in which protective functions consisting of the protection against a short circuit and a protection against a thermal overload are combined in one unit and in which the thermal trip does not carry current and which has a much lower power consumption (power loss) than the known designs. In that previously known overcurrent trip a thermal release is effected by a snap-action bimetal disk, which is mounted in a rotationally symmetrical carrying body that has a high thermal conductivity. But that printed publication does not disclose a combination of that overcurrent trip with a latching mechanism and arc-quenching means, as is required for high switching capacities.

SUMMARY OF THE INVENTION

It is an object of the invention to provide a line circuit breaker that has a high short circuit breaking capacity and a long useful life and owing to a simplified functional design can be manufactured in large quantities in a highly mechanized production.

That object is accomplished in accordance with the invention by a circuit breaker having the features of claim 1. Preferred features of the invention will become apparent from the dependent claims.

The circuit breaker in accordance with the invention desirably comprises high-duty arc-quenching means and a latching mechanism, which is adapted to be electromagnetically and thermoelectrically unlatched by means of a snap-action bimetal element to open contacting means in response to an overload. The snap-action bimetal element is mounted in a carrying body, which has a high thermal conductivity and carries an electromagnetic exciter coil and contains an associated plunger, which is adapted to be actuated by the snap-action bimetal element or electromagnetically, and a functional relationship between the overload release and the opening of a movable contact of the contacting means is established in that the latching mechanism is unlatched by means of a first arm of a rotatably mounted two-armed lever in response to a tripping movement of the plunger, the second arm of the lever strikes open the movable contact and the second arm is integrally formed with a baffle wall for urging an electric arc column toward the arc-quenching means as the circuit is broken.

In accordance with the above the invention provides a two-armed lever having a plurality of functions. Primarily it serves to transmit the releasing force to the kinematic means for unlatching the latching mechanism. It serves also as a striking lever for applying striking energy to the movable contact of the contacting means and finally provides a baffle wall for urging the plasma column.

In order to provide a simplified design and optimum functional characteristics in conjunction with a compact structure, it is desirable in accordance with a preferred feature of the invention that the two-armed lever is pivoted to the overcurrent trip, particularly to the associated carrying body, preferably on a pivot by which the carrying body is adapted to be mounted. That design is desirable also from the aspect of manufacture.

A further functional and kinematic simplication within a confined space will also be achieved if the two-armed lever is mounted on the carrying body on that side which faces the contacting means.

According to a further preferred feature of the invention the lever consists of an insulating material which releases a gas under the action of an electric arc and preferably consists of lucite. In that case a desirable effect is utilized which resides in that a release of gas under pressure will be effected within milliseconds under the action of an electric arc and the action of the baffle wall will be increased so that the electric arc will quickly be urged away to the high-duty arc-quenching means.

According to a preferred further feature of the invention the carrying body, which has a high thermal conductivity, is preferably rotationally symmetrical and contains a stationary core for guiding the plunger and a displaceable armature for actuating the plunger so that the plunger can be moved by the snap-action bimetal element and under the action of the armature for actuating the plunger.

The snap-action bimetal element may have any desired form which is required for an adaptation to the conditions in any given case. As regards the overall size and the mode of operation it will be particularly favorable to provide a snap-action bimetal element consisting of a disk, which has a central through opening for receiving the plunger, and the plunger is integrally formed adjacent to the disk with a projection for engaging the disk. The snap-action disk itself is desirably centrically disposed in a bimetal chamber in front of the core for guiding the plunger and has a convex surface in contact with said core. Alternatively the armature for actuating the plunger may axially extend between the core for guiding the plunger and the snap-action disk, which is held in a bimetal-containing chamber, and the plunger may be guided in the armature for actuating the plunger. Various designs may be adopted in any given case to provide a circuit breaker which will effectively and reliably meet specified spatial and functional requirements.

According to a preferred feature of the invention the bimetal-containing chamber is closed by a disklike element, which consists of electrically insulating material and has a through bore for guiding the plunger and is particularly suitable for use with a rotationally symmetrical carrying body.

The disklike element is desirably provided with a receptacle for a conductor leading to the stationary contact and that conductor is connected to the exciter coil and the arc-quenching means. It will also be desirable for the manufacture and assembling to arrange the bimetal-containing chamber and the conductor leading to the stationary contact on the same side.

Further details, features, and advantages of the invention will become apparent from the following description, in which a preferred illustrative embodiment of the invention will be explained more in detail with reference to the accompanying drawings.

DETAILED DESCRIPTION OF THE PREFERRED EMBODIMENT

Figure 1:
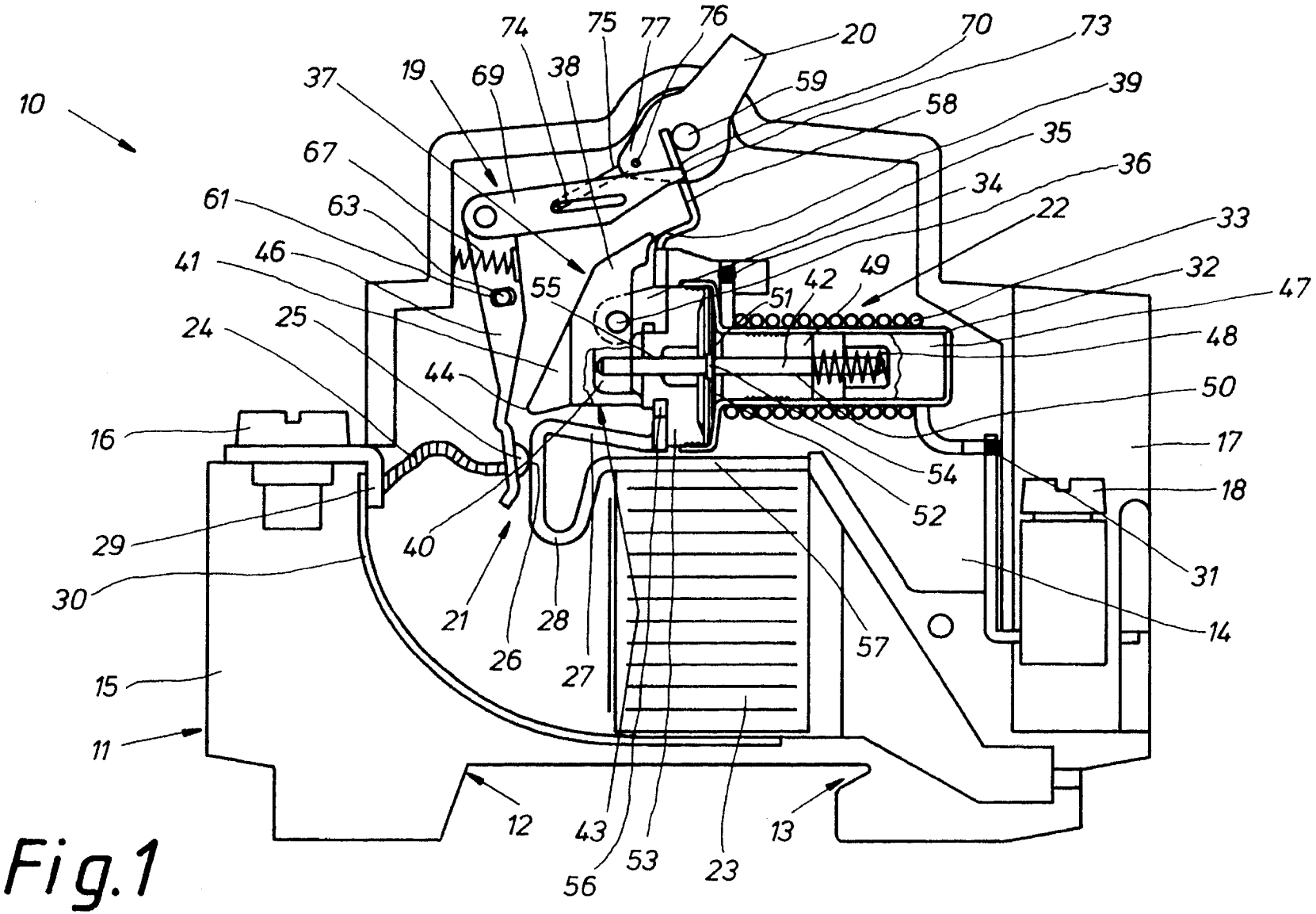
FIG. 1 is a schematic sectional view showing an illustrative embodiment of a circuit breaker in accordance with the invention in an untripped state.
Figure 2:
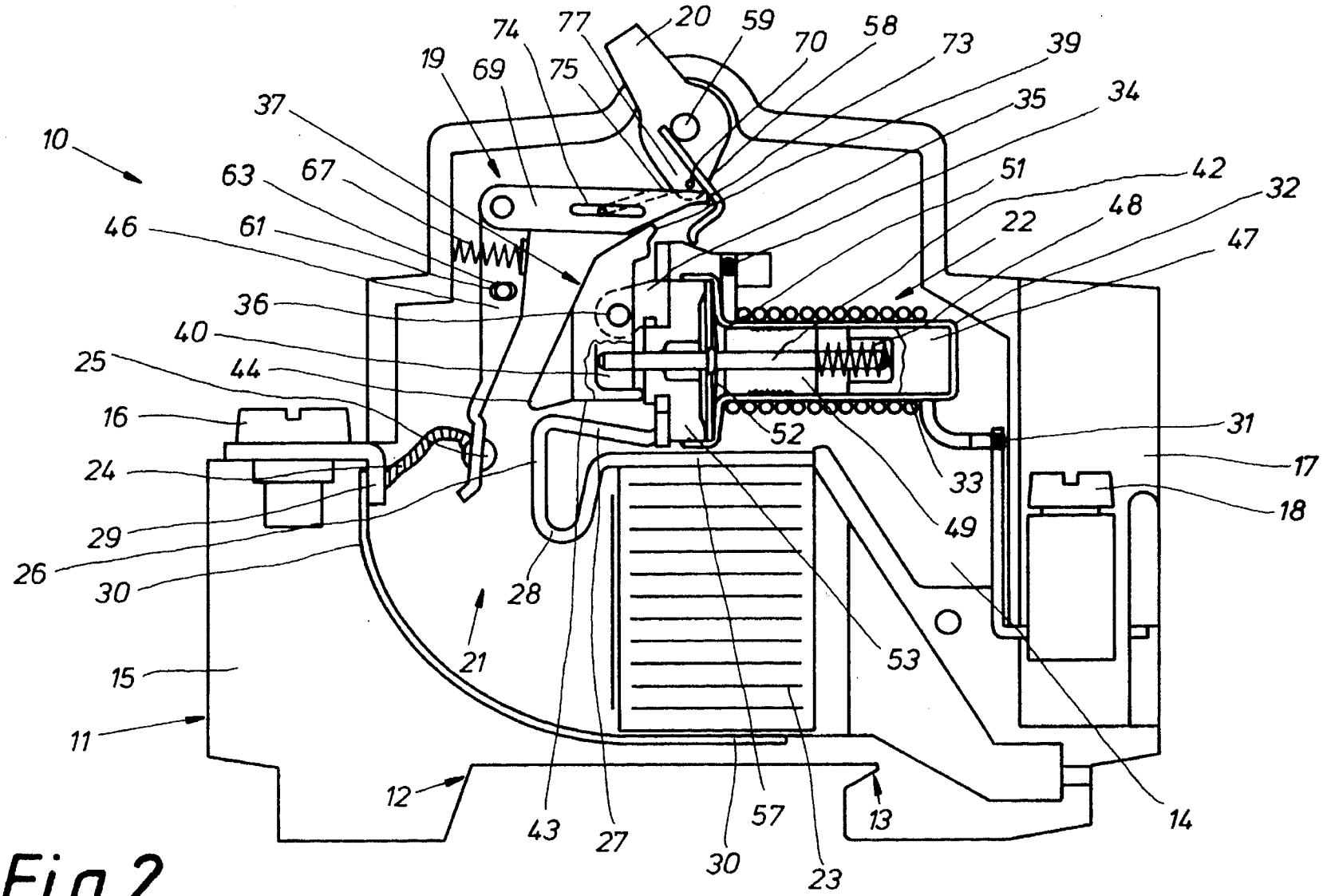
FIG. 2 is an elevation showing the circuit breaker of FIG. 1 in a magnetically tripped state.

FIG. 1 shows a preferred embodiment of a circuit breaker 10, which comprises a narrow housing 11 made of an insulating plastic and on its rear side, at the bottom in FIGS 1 and 2, is provided with receptacles 12 and 13 for being fitted on a conventional mounting rail. The housing 11 comprises an interior chamber 14, a top portion 15, which is provided with a terminal 16, and a bottom portion 17, which is provided with a terminal 18.

A latching mechanism 19, an overcurrent trip 22, and high-duty arc-quenching means 23 are fixedly mounted in the interior chamber 14. The latching mechanism 19 comprises a movable switching toggle 20, which protrudes out of the housing 11, and contacting means 21.

The terminal 16 is connected by a movable flexible lead 24 to the movable contact 25 of the contacting means 21. The complementary stationary contact 26 of the contacting means 21 consists of a portion of a solid conductor 27, which has a thickness of about 1.2 mm and extends from the overcurrent trip 22 via the stationary contact 26 and a loop 28 to the high-duty arc-quenching means 23. An arcuate arc-guiding plate 30 extends between an angled portion 29 of the terminal 16 and a rear portion, which is close to the arc-quenching means 23. The flexible lead 24 is secured to the angled portion 16.

The terminal 18 is connected by a weld 31 to the overcurrent trip 22. More specifically, the overcurrent trip 22 comprises a rotationally symmetrical, hollow cylindrical carrying body 32, which has a high thermal conductivity and comprises a portion, on which a coil 33 is wound in tight contact therewith. One end of the coil 33 is connected by the soldered joint 31 to the terminal 18. The other end of the coil 33 is connected via a soldered joint 34 and a mounting plate 35 to the conductor 27 in the forward portion of the carrying body 32. The mounting plate 35 serves to fix the carrying body 32 in the interior chamber 14 of the housing 11 by means of a pin 36, which serves also as a pivot for a two-armed lever 37.

The two-armed lever 37 comprises a first arm 38, that is provided with an unlatching nose 39, and is also integrally formed with an abutment portion 40, over which the mounting plate 35 extends, and a second arm 41, which is engageable by a plunger 42 of the overcurrent trip 22 within the abutment portion 40. The second arm 41 is integrally formed on its rear side (on the underside in FIGS. 1 and 2) with a baffle wall 43 and with a nose 44, which serves to strike open the movable contact 25, which is provided on a first arm 45 of a two-armed contact-carrying lever 46.

The carrying body 32 of the overcurrent trip 22 contains a movable armature 47, which serves to actuate the plunger 42 and by means of a spring 48 that is guided by the plunger 42 is biased away from a core 49 for guiding the plunger. The core 49 has a central bore 50, in which the plunger 42 is guided. The core 49 for guiding the plunger as well as the armature 47 for actuating the plunger are rotationally symmetrical. Whereas the armature 47 for actuating the plunger is movable, the core 49 for guiding the plunger is fixedly mounted in the cylindrical interior chamber of the hollow carrying body 32.

A bimetal-containing chamber 51 is disposed in front of the core 49 for guiding the plunger, in FIGS. 1 and 2 on the left of said core. The bimetal-containing chamber 51 contains a snap-action bimetal disk 52, which is held by a disklike element 53 in an enlarged portion of the carrying body 32. The bimetal disk 52 has a central bore, which is only slightly larger in diameter than the plunger 42, so that a disk-engaging protection 54 integrally formed with the plunger 42 can be engaged by the bimetal disk 52 for moving the plunger 42 to effect a thermally induced release. The disklike element 53 has also a through opening 55 for receiving the plunger 42, which in its initial position is clear of the two-armed lever but protrudes into the abutment portion 40, which is integrally formed with the lever 37. The conductor 27 is secured in a receptacle 56, that is provided on the disklike element 53, and the conductor 27 is conductively connected to the other end of the coil. The looped portion 28 of the conductor 27 is succeeded by an arc-guiding straight portion 57, which is parallel to the front side of the arc-quenching means 23.

The unlatching nose 39 of the two-armed lever 37 serves to engage an angled tripping lever 58, which is a functional part of the latching mechanism 19. The tripping lever 58 is pivoted on a pivot 59, which is fixed to the housing and which constitutes also a pivot for the switching toggle 20.

The latching mechanism 19 comprises also the above-mentioned two-armed contact-carrying lever 46, which has a slot 61, which extends transversely to the longitudinal direction of the contact-carrying lever 46. A pivot 63 is secured to the housing and extends through the slot 61 and serves to guide the contact-carrying lever 46. The contact-carrying lever 46 bears on the housing 11 by means of a spring 67, which biases the contact-carrying lever 46 in the clockwise sense as shown on the drawings. The contact-carrying lever 46 is pivoted to an intermediate lever 69, which has a noselike free end portion 73, which is latched by a stop 70 of the tripping lever 58. The intermediate lever 69 is formed with a slot 74, which receives one end of a U-shaped member 75, which at its other end extends into a bore 76 in a projection 77 that is integrally formed with the switching toggle 20.

When a high overcurrent results in a tripping excitation of the coil 33 or when a relatively low overcurrent sustained for a substantial time results in a temperature rise of the carrying body 32 owing to the heat-conducting contact between the coil 33, which is wound on the carrying body 32, and the latter, and said temperature rise is transmitted to the snap-action bimetal disk, the plunger 42 will be actuated to move out of its initial position shown in FIG. 1. This is effected either electromagnetically or by the snap action of the bimetal disk 52. As a result, the plunger 42 strikes against the second arm 41 of the two-armed lever 37, and the nose 44 strikes against the first arm 45 of the contact-carrying lever 46 so that the movable contact 44 of the contacting means 21 is struck open. Because the two-armed lever 37 is made of an insulating material which under the action of an electric arc releases a gas and particularly consists of lucite, gas will intermittently be released and will desirably urge the electric arc which has been generated to the arc-quenching means 23. When the electric arc impinges on the baffle wall 43 of the lever 37, that baffle wail 43 will deflect the electric arc into the intended direction.

At the same time the unlatching nose 39 of the two-armed lever 37 strikes against the tripping lever 58 to unlatch the latter from the intermediate lever 69 and the pressure applied by the spring 67 will then turn the contact-carrying lever 45 in the clockwise sense. By means of the intermediate lever 69 the U-shaped member 75 is then moved to the right so that the switching toggle 20 is rotated in a counterclockwise sense to its break position and the lever 46 which carries the movable contact is held in its open position. In that position the contacting means 21 will reliably be held open by the latching mechanism 19.

FIG. 2 shows the circuit breaker 10, in which the contacting means 21 are reliably held open after an electromagnetic or thermoelectric release.

I claim:

1. A circuit breaker comprising:

high-duty arc-quenching means and a latching mechanism, said latching mechanism adapted to be electromagnetically and thermoelectrically unlatched by a snap-action bimetal element to open contacting means in response to an overload, said snap-action bimetal element mounted in a carrying body, said body having a high thermal conductivity and carrying an electromagnetic exciter coil, said body further containing an associated plunger, said plunger adapted to be actuated by said snap-action bimetal element and electromagnetically, said latching mechanism adapted to be unlatched by a first arm of a pivoted two-armed lever in response to an actuation of said plunger, wherein the second arm of the lever is adapted to strike open said contacting means, and the second arm is provided with a baffle wall for urging toward the arc-quenching means a plasma or arc column which is generated as the contacting means are struck open.

2. A circuit breaker according to claim 1, wherein the two-armed lever is pivoted to the carrying body by means of a pivot.

3. A circuit breaker according to claim 1, wherein the carrying body is adapted to be fixed by means of a pivot, on which the two-armed lever is pivotally mounted.

4. A circuit breaker according to claim 1, wherein the two-armed lever is pivoted on that side of the carrying body which faces the contacting means.

5. A circuit breaker according to claim 1, wherein the two-armed lever comprises an insulating material which releases gas under the action of an electric arc.

6. A circuit breaker according to claim 1, wherein the two-armed lever comprises lucite.

7. A circuit breaker according to claim 1, wherein the carrying body contains a core for guiding the plunger and a displaceable armature for actuating the plunger.

8. A circuit breaker according to claim 1, wherein the snap-action bimetal element comprises a disk, which has a central through bore for receiving the plunger, which adjacent to the disk is integrally formed with a projection for engaging the disk.

9. A circuit breaker according to claim 1, wherein the snap-action bimetal element comprises a disk with a central through bore is centrally disposed in a bimetal-containing chamber in front of a core for guiding the plunger and has a convex surface in contact with said core.

10. A circuit breaker according to claim 1, wherein an armature for actuating the plunger extends axially between a core for guiding the plunger and the snap-action bimetal element, which is held in a bimetal-containing chamber, and the plunger is guided in the armature for actuating the plunger.

11. A circuit breaker according to claim 1, wherein a bimetal-containing chamber for holding said bimetal element is closed by a disklike element, which is made of an electrically insulating material and has a through bore for guiding the plunger.

12. A circuit breaker according to claim 1, wherein an element for closing a bimetal-containing chamber for holding said bimetal element is provided with a receptacle for a conductor, which leads to a stationary contact and is connected to the exciter coil and the arc-quenching means.

13. A circuit breaker according to claim 1, wherein a bimetal-containing chamber for holding said bimetal element and a conductor leading to a stationary contact are disposed on the same side of the carrying body.

* * * * *